US007513399B2

(12) United States Patent
Mengeu

(10) Patent No.: US 7,513,399 B2
(45) Date of Patent: Apr. 7, 2009

(54) CLOSURE WITH SELECTABLE DISPENSING ORIFICES

(75) Inventor: Gary L. Mengeu, Wheeling, WV (US)

(73) Assignee: Silgan Plastics Corporation, Chesterfield, MO (US)

( * ) Notice: Subject to any disclaimer, the term of this patent is extended or adjusted under 35 U.S.C. 154(b) by 584 days.

(21) Appl. No.: 11/363,632

(22) Filed: Feb. 28, 2006

(65) Prior Publication Data

US 2007/0199962 A1 Aug. 30, 2007

(51) Int. Cl.
*B65D 5/72* (2006.01)

(52) U.S. Cl. ..... 222/575; 222/567

(58) Field of Classification Search ..... 222/575, 222/567, 147, 480, 534, 211, 107, 174, 498, 222/555, 526, 547, 402.17, 330, 331, 565, 222/544, 548; 239/390, 391, 392, 394, 395, 239/393; 221/154; 215/235
See application file for complete search history.

(56) References Cited

U.S. PATENT DOCUMENTS

| | | | | | |
|---|---|---|---|---|---|
| 2,697,485 | A | * | 12/1954 | McNally | 431/280 |
| 2,961,133 | A | | 11/1960 | Ankney | |
| 3,094,283 | A | * | 6/1963 | Balister | 239/393 |
| 3,891,128 | A | | 6/1975 | Smrt | |
| 4,346,823 | A | | 8/1982 | Eppenbach | |
| 4,487,324 | A | * | 12/1984 | Ostrowsky | 215/253 |
| 4,489,864 | A | | 12/1984 | Davis | |
| 4,611,725 | A | | 9/1986 | Kacalieff | |
| 4,699,299 | A | | 10/1987 | Gach | |
| 4,832,219 | A | | 5/1989 | Nycz | |
| 5,123,574 | A | * | 6/1992 | Poulos | 222/362 |
| 5,195,645 | A | | 3/1993 | Schuermann | |
| 5,269,432 | A | | 12/1993 | Beckertgis | |
| 5,383,582 | A | | 1/1995 | Baxter et al. | |
| 5,421,472 | A | | 6/1995 | Beckertgis | |
| 5,730,322 | A | | 3/1998 | Iba et al. | |

(Continued)

OTHER PUBLICATIONS

Cheetos Squeeze Tube product images, available to Assignee at least by Jun. 22, 2005, 1 page.

*Primary Examiner*—George Nguyen
*Assistant Examiner*—Michael Hagedorn
(74) *Attorney, Agent, or Firm*—Foley & Lardner LLP

(57) ABSTRACT

A dispenser for dispensing a viscous material in a selected one of a multiplicity of configurations comprises a container having a squeezable body and neck with a discharge opening at its upper end. Engaged with the container is a closure body of generally circular cross section with a top wall and skirt. The top wall has a post with a discharge passage therethrough aligned with the neck discharge opening. A generally circular rotating disc is rotatably disposed on the closure body top wall and has a central hub seating said post. The post has an aperture alignable with the hub discharge passage for passage of viscous material therethrough. The disc has a multiplicity of flow openings spaced about the disc in a circular array and represents a multiplicity of configurations. The disc also has a multiplicity of flow channels extending from the post to the flow openings of the disc, and it is rotatable to align the flow channel of the selected flow opening with the aperture in the post to permit viscous material to flow through the neck and top wall of the closure body into the post and outwardly in flow channels to a selected disc discharge opening.

10 Claims, 4 Drawing Sheets

U.S. PATENT DOCUMENTS 5,738,236 A * 4/1998 Brun, Jr. ..... 220/253
6,286,767 B1 * 9/2001 Hui-Chen ..... 239/394
6,446,842 B2 9/2002 Stern et al.
6,488,187 B2 12/2002 Sheffler et al.
2003/0042331 A1 * 3/2003 Lu ..... 239/436
2006/0237560 A1 * 10/2006 Chih ..... 239/394
2007/0199959 A1 8/2007 Getsy

* cited by examiner

CLOSURE WITH SELECTABLE DISPENSING ORIFICES

BACKGROUND OF THE INVENTION

The present invention relates to containers and, more particularly, containers for dispensing viscous materials such as foodstuffs and decorative materials.

Dispensers for various types of viscous materials include tubes of frosting, sealant cartridges, toothpaste tubes and the like. In some instances, the dispensers have a fitment which provides both a large aperture and a small aperture for dispensing, either of which may be selected depending upon the volume to be dispensed.

Some food products employ packaging which allows children to dispense a food product by squeezing a compressible container containing a viscous comestible such as cheese, peanut butter, jelly and the like. The child is able to make patterns of the food product on a cracker or bread slice, thus providing some play action.

It is an object of the present invention to provide a novel squeezable container for a viscous product which can be discharged through a dispensing closure which provides a multiplicity of discharge openings of different cross section.

It is also an object to provide such a container which permits facile switching among the several discharge openings.

Another object is to provide such a squeezable container which may be readily assembled from easily fabricated components.

SUMMARY OF THE INVENTION

It has now been found that the foregoing and related objects can be readily attained in a dispenser for dispensing a viscous material in a selected one of a multiplicity of configurations comprising a squeezable container for a volume of a viscous material and having a body and a neck with a discharge opening at its upper end. Engaged with the container is a closure body of generally circular cross section having a top wall and a skirt, and the wall has a central post with a discharge passage therethrough aligned with the discharge opening of the neck.

A generally circular disc is disposed on the closure body top wall, and overlies and is rotatable on the top wall of the closure body. The disc has a center hub seated on the post and has an aperture therein alignable with the discharge passage of the closure body hub for passage of viscous material therethrough. The disc has a multiplicity of flow openings spaced about the disc in a circular array and the flow openings represent a multiplicity of configurations. The disc also has a multiplicity of flow channels extending from the post to the flow openings of the disc, and the disc is rotatable to align the flow channel of the selected flow opening with the aperture in the post. This permits viscous material to flow though the neck and top wall of the closure body into the post and outwardly in the flow channels to a selected disc discharge opening.

Preferably, the disc has a peripheral channel opening downwardly and the top wall of the closure body has an upstanding circular ring which snaps fitted into the channel to provide the rotatable engagement of the disc on the closure body. Desirably, the peripheral channel is formed in a peripheral boss on the upper surface of the disc, and the discharge openings are in circular bosses on the disc.

Generally, the container neck is externally threaded and the bottom surface of the closure body has a depending threaded barrel portion which is threadably engaged with the neck. Preferably, the container is a flexible tubular member sealed at the end opposite the neck. The post discharge passage is formed in the side wall of the post and has a width substantially equal to the width of the flow channels.

Desirably, the closure also includes an overcap having a top wall and peripheral skirt. The disc has an upstanding boss extending about the periphery thereof and it is of lesser diameter than the top wall of the closure body to provide a shoulder on which the skirt of the overcap seats. The channel in the boss has an undercut portion and the top wall of the closure body has a ring formulation with an enlarged portion at its upper end to provide the snap fit.

DETAILED DESCRIPTION OF THE PREFERRED EMBODIMENTS

Figure 1:
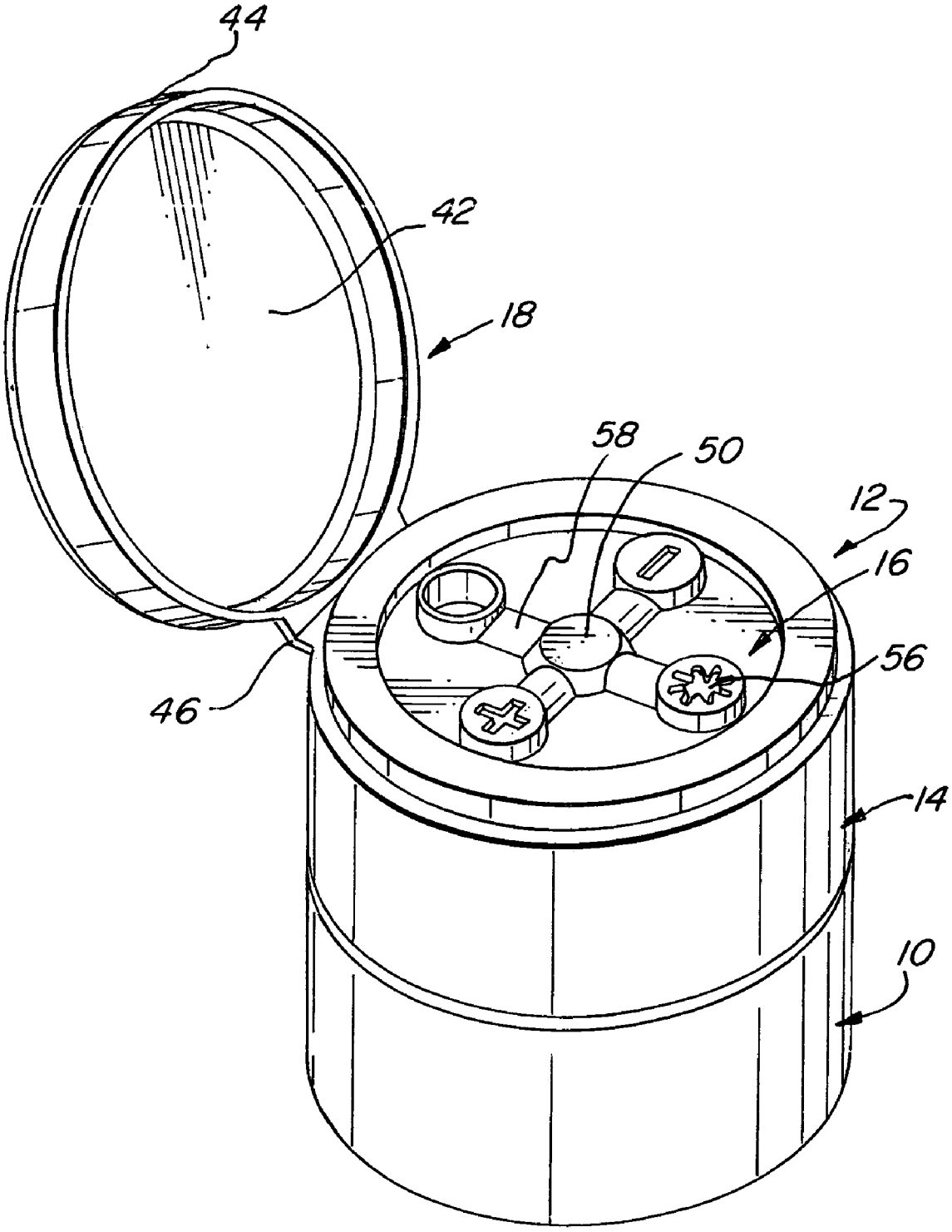
FIG. 1 is a perspective view of a container embodying the present invention and with the overcap pivoted into an open position and the tubular container fragmentarily illustrated.
Figure 2:
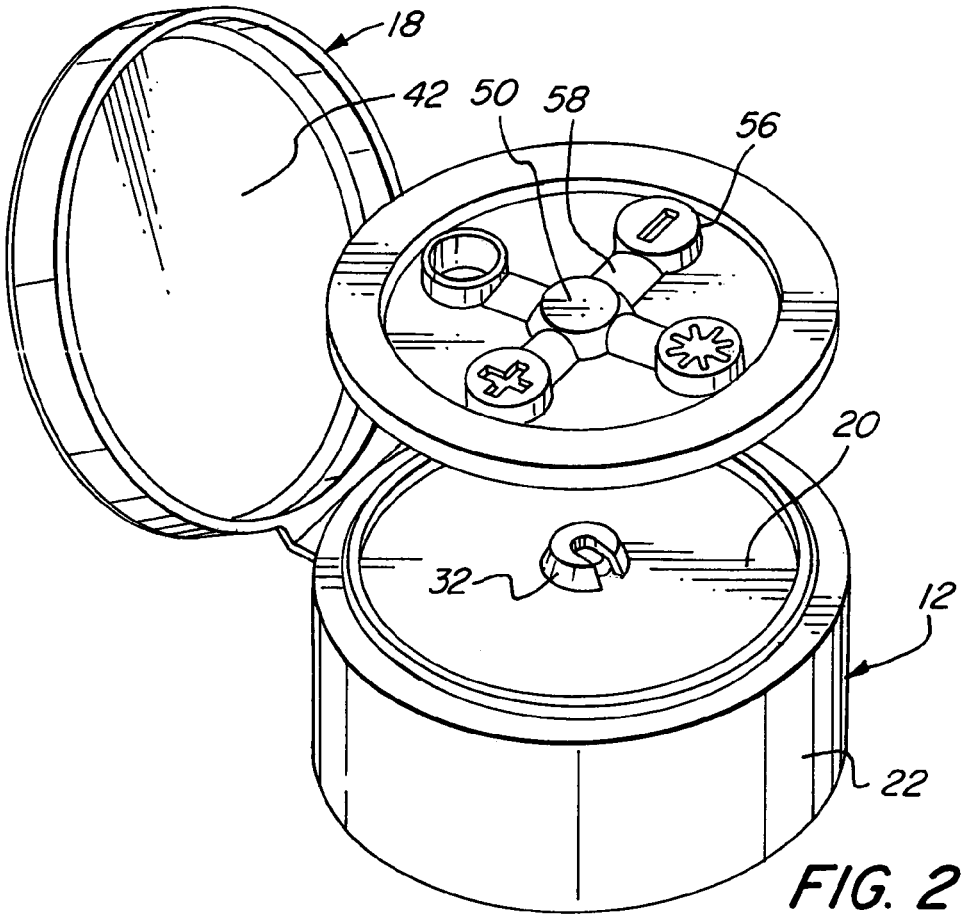
FIG. 2 is a perspective view of the closure body with the disc removed from the body.
Figure 3:
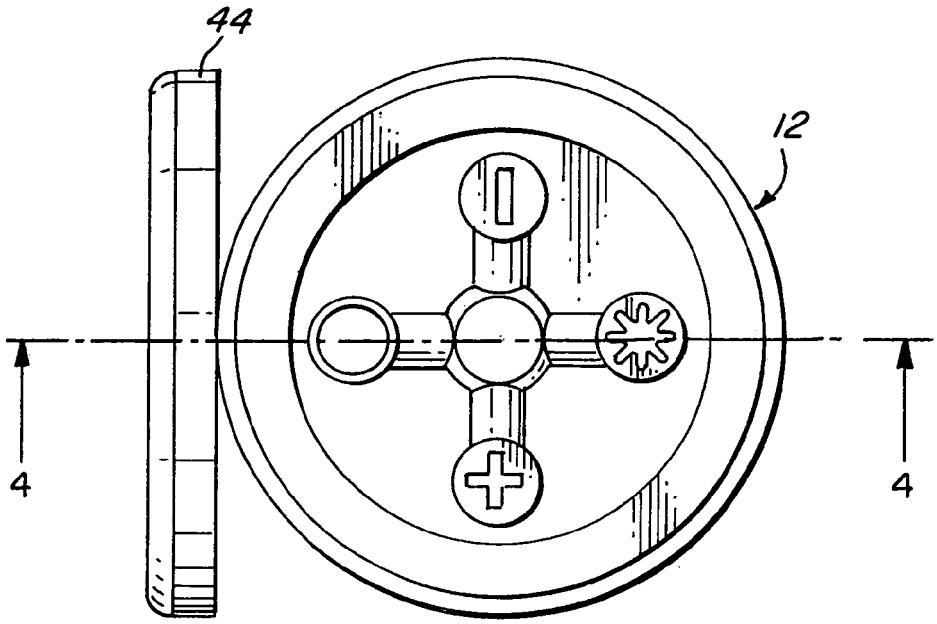
FIG. 3 is a plan view of the closure with the overcap in the open position.
Figure 4:
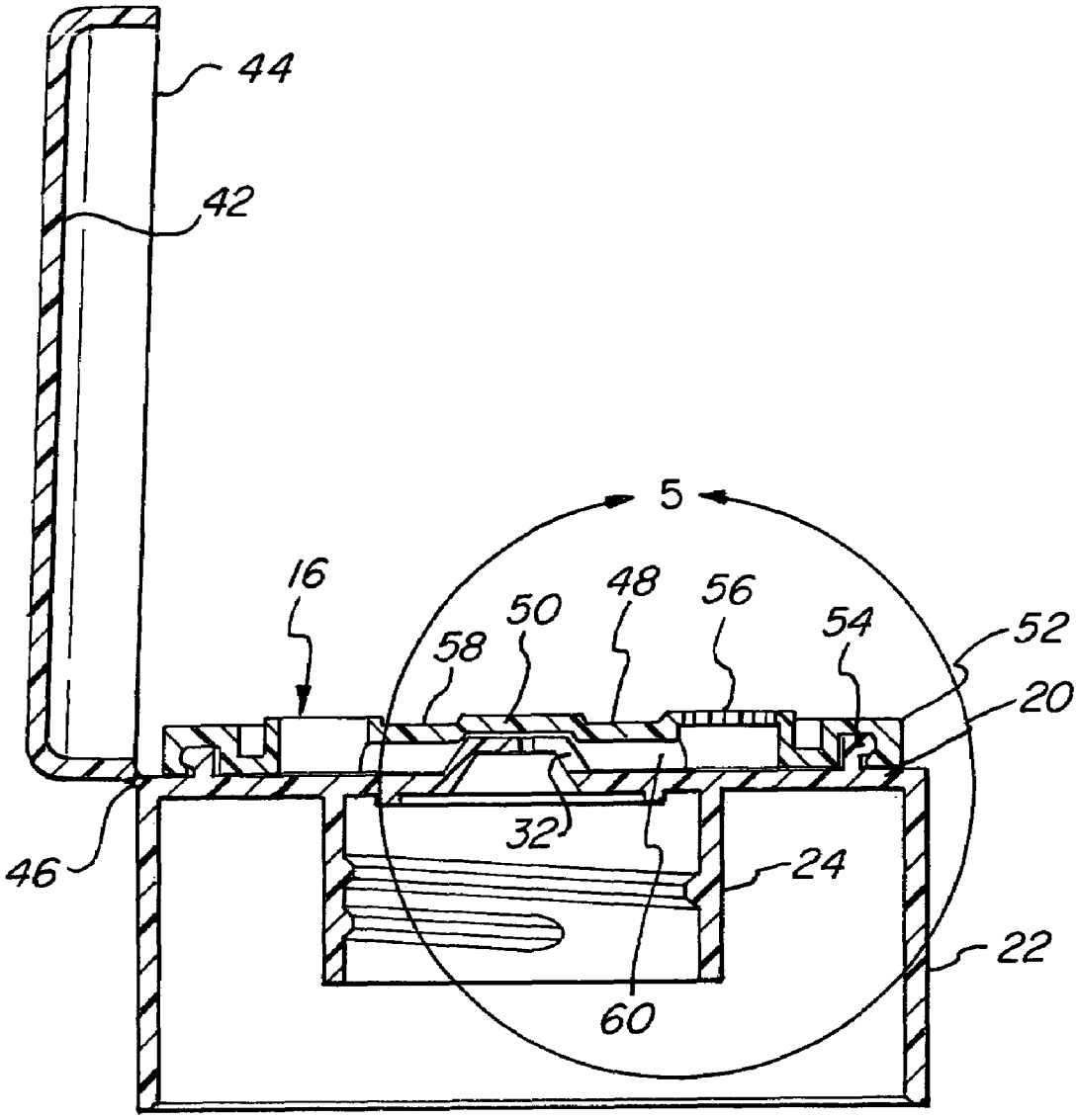
FIG. 4 is an enlarged fragmentary sectional view of the closure along the line 4-4 of FIG. 3.
Figure 5:
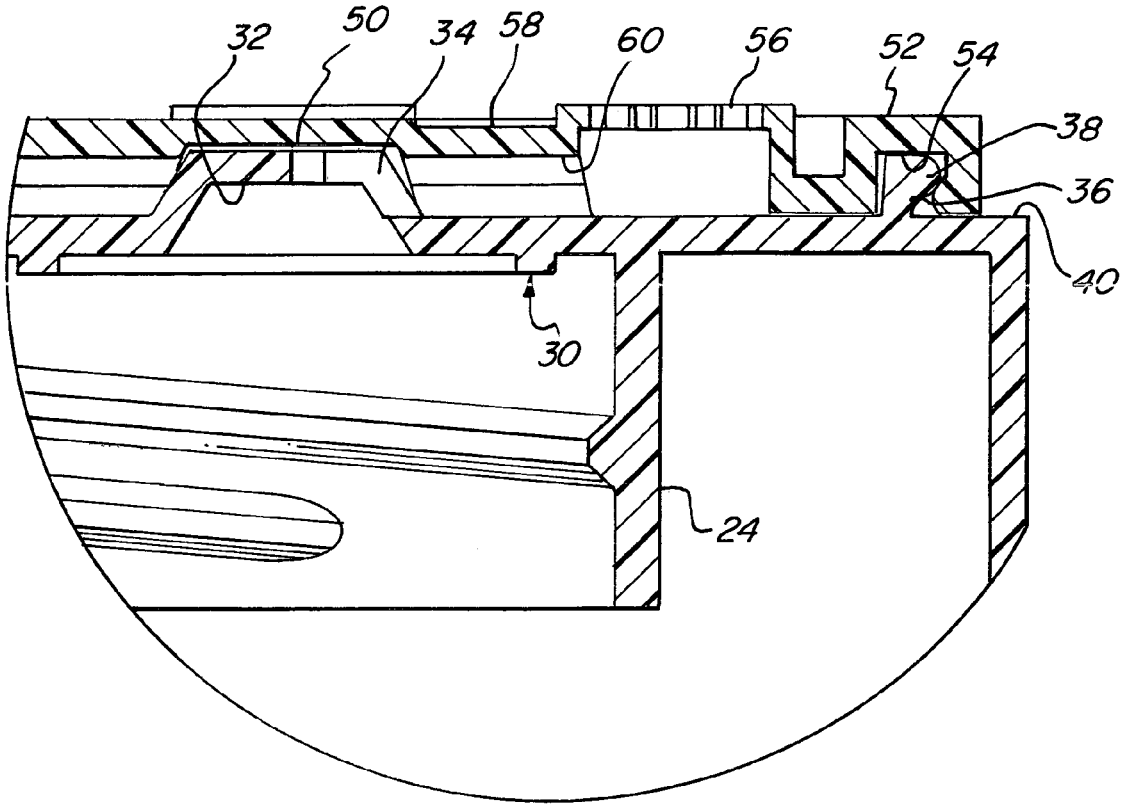
FIG. 5 is an enlarged fragmentary sectional view of the circled portion in FIG. 4.
Figure 6:
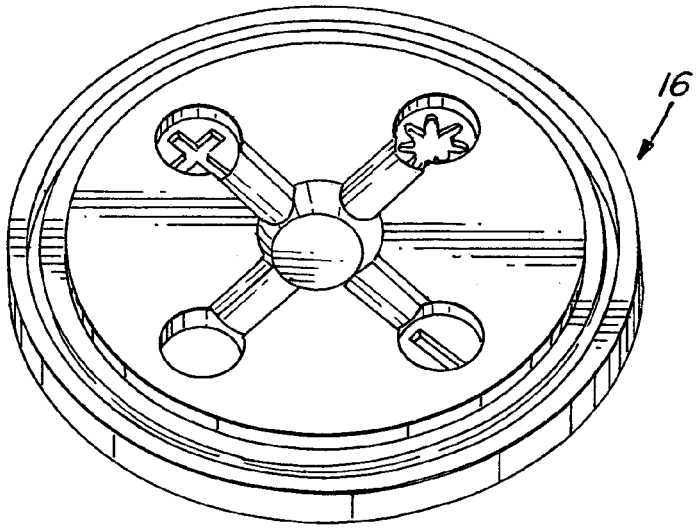
FIG. 6 is a plan view of the disc.

Turning first to FIG. 1 of the attached drawings, therein illustrated is a dispenser embodying the present invention comprising a tubular container generally designated by the numeral 10 and a dispensing closure generally designated by the numeral 12. The closure 12 has a body generally designated by the numeral 14, a dispenser disc generally designated by the numeral 16, and an overcap generally designated by the numeral 18.

As seen in FIGS. 2-5, the closure 12 has a top wall 20 and a peripheral depending skirt 22. A threaded barrel 24 depends from the lower surface of the top wall 20 and the neck 26 of the container 10, and the lip 28 of the container neck 26 bears against the annular ring 30 on the lower surface of the top wall 20. In the center of the top wall 20 is an upstanding frustoconical post 32 with a discharge passage or slot 34 at a point about the periphery thereof. Extending about the upper surface of the top wall 20 is an upstanding boss or rib 36 with an enlarged portion 38 at its upper end. The boss 36 is spaced radially inwardly from the periphery of the top wall 20 to provide a shoulder 40.

The overcap 18 has a top wall 42 and a peripheral skirt 44 which seats on the shoulder 40. The closure is integrally molded with a hinge 46.

Turning now in detail to the disc 16, it is of circular configuration with a top wall 48, a central hub 50 having a frustoconical recess seating the post 32 and a peripheral flange 52 having a downwardly opening channel 54 therein into which the boss 36 snaps to provide a rotatable engagement thereon. Spaced about the top wall 48 are a multiplicity of discharge openings 56 of different configurations. A series of spoke-like bosses 58 radiate from the hub 50 and provide flow channels 60 from the discharge passage 34 in the post 32 to the discharge openings 56 when the passage 34 and a flow channel 60 are aligned.

It will be readily appreciated that the squeezable container can take the form of a tube or a bottle, and it can be easily fabricated by extrusion and molding of tubular shapes, and injection and blow molding of synthetic resin to form bottles in accordance with general technology. The resin employed should allow facile squeezing to compress the container and force material to flow outwardly of the container. Polyolefins have proven highly acceptable for such applications.

The closure and disc do not require a flexible construction and are also conveniently molded from polyolefins although other more rigid resins may also be employed.

The three components are easily fabricated and assembled. Preferably, the disc and closure may be assembled and then threaded onto the container. The container can be filled through the neck, or, in the instance of tubes, they can be filled and then the opposite end is closed and sealed.

In use, the child (or adult) can rotate the disc to align the discharge opening of the desired configuration in the operational position. Squeezing the container will then force material to flow from the interior of the container through the neck into the post and then outwardly through a flow channel to a discharge opening. The discharging material has the shape or configuration of the discharge opening selected and continuous beads or small deposits can be generated. When the squeezing pressure on the container is released, flow from the container ends. The material in the closure passages can be "sealed" by rotating the disc to a position in which the flow channels are not aligned with the discharge passage in the post.

Thus, it can be seen from the foregoing detailed description and the attached drawings that it is an object of the present invention provides a novel squeezable container for a viscous product which can be discharged through a dispensing closure which provides a multiplicity of discharge openings of different cross sections.

The container permits facile switching among the several discharge openings and it may be readily assembled from easily fabricated components.

What is claimed is:

1. A dispenser for dispensing a viscous material in a selected one of a multiplicity of configurations comprising:

(a) a container for a volume of a viscous material, said container having a squeezable body and a neck with a discharge opening at its upper end;

(b) a closure body of generally circular cross section having a top wall and a skirt, said top wall having a coaxial post with a discharge passage therethrough aligned with said discharge opening of said neck, said closure body having means thereon engaging said container; and (c) a generally circular rotatatable disc overlying said top wall of said closure body and being rotatable thereon, said disc having a central hub seating said post and having an aperture therein alignable with said discharge passage of said closure post for passage of viscous material therethrough, said disc having a multiplicity of flow openings spaced about said disc in a circular array, said flow openings representing a multiplicity of configurations, said disc having a multiplicity of flow channels extending from said post to said flow openings of said disc, said disc being rotatable to align the flow channel of the selected flow opening with said aperture in said post to permit viscous material to flow through said neck and top wall of said closure body into said post and outwardly in said flow channels to a selected flow opening.

2. The dispenser in accordance with claim 1 wherein said disc has a peripheral channel opening downwardly and said top wall of said closure body has an upstanding circular ring which snap fits into said peripheral channel to provide the rotatable engagement of said disc on said closure body.

3. The dispenser in accordance with claim 2 wherein said peripheral channel is formed in an upwardly extending peripheral boss on said disc top wall.

4. The dispenser in accordance with claim 3 wherein said flow openings are in circular bosses on said disc.

5. The dispenser in accordance with claim 1 wherein said container neck is externally threaded and wherein the bottom surface of said closure body has a depending threaded barrel portion, said threaded neck being threadably engaged with said neck.

6. The dispenser in accordance with claim 1 wherein said container is a flexible tubular member sealed at the end opposite said neck.

7. The dispenser in accordance with claim 1 wherein said post discharge passage is formed in the side wall of said post and has a width substantially equal to the width of said flow channels.

8. The dispenser in accordance with claim 1 wherein said closure body includes an overcap having a top wall and peripheral skirt extending over said disc and closure top wall.

9. The dispenser in accordance with claim 8 wherein said disc has an upstanding boss extending about the periphery thereof, said boss being of lesser diameter than said top wall of said closure body to provide a peripheral step and said skirt of said overcap seats thereon.

10. The dispenser in accordance with claim 3 wherein said peripheral channel in said peripheral boss has an undercut portion and said top wall of said closure body has a ring formulation with an enlarged portion at its upper end to provide said snap fit.

* * * * *